United States Patent [19]

McKelvy

[11] Patent Number: 4,641,727

[45] Date of Patent: Feb. 10, 1987

[54] ELECTRICALLY INSULATED TEMPORARY AERIAL PLATFORM

[75] Inventor: Marvin D. McKelvy, Centralia, Mo.

[73] Assignee: A. B. Chance Company, Centralia, Mo.

[21] Appl. No.: 861,835

[22] Filed: May 12, 1986

[51] Int. Cl.[4] ..... A45F 3/26; E04G 5/08

[52] U.S. Cl. ..... 182/46; 182/187

[58] Field of Search ..... 182/46, 47, 187, 188, 182/113, 106; 108/152

[56] References Cited

U.S. PATENT DOCUMENTS

| | | | |
|---|---|---|---|
| 1,026,380 | 5/1912 | Brooks | 182/46 |
| 1,515,831 | 11/1924 | Bush | 182/46 |
| 1,915,715 | 6/1933 | Bodeudieck | 182/188 |
| 2,168,111 | 8/1939 | Barnes | 182/46 |
| 3,392,802 | 7/1968 | Moore | 182/187 |
| 3,396,818 | 8/1968 | Moragne | 182/187 |
| 3,749,200 | 7/1973 | Meyer | 182/187 |
| 4,244,445 | 1/1981 | Strode | 182/187 |
| 4,484,660 | 11/1984 | Baynum | 182/187 |
| 4,549,635 | 10/1985 | Early | 182/187 |

*Primary Examiner*—Reinaldo P. Machado

*Attorney, Agent, or Firm*—Schmidt, Johnson, Hovey & Williams

[57] ABSTRACT

An electrically insulated aerial platform assembly for use by a lineman on or around utility poles is provided which is constructed to maintain the actual work platform in an electrically insulated condition relative to the utility pole itself and the pole connection hardware associated with the assembly. In preferred forms, the platform assembly includes a work platform presenting an elongated, substantially flat upper work surface where a lineman may by stand, sit or kneel, together with means for temporarily attaching the platform to the utility pole with the platform being electrically insulated from the pole during normal working conditions. Attachment of the platform to the pole is effected by means of an elongated, electrically insulative member secured to the platform and extending toward the pole, with the pole-connection structure coupled to the insulative member at the end thereof remote from the platform. The insulative member is of a length and is formed of an appropriate insulative material presenting a smooth outer surface for resisting accumulation of dirt or other contaminants thereon to maintain the electrical integrity of the overall assembly. Moreover, the insulative member preferably presents a downwardly sloping upper surface in order to dissuade the lineman from directly contacting and supporting himself on the member.

6 Claims, 5 Drawing Figures

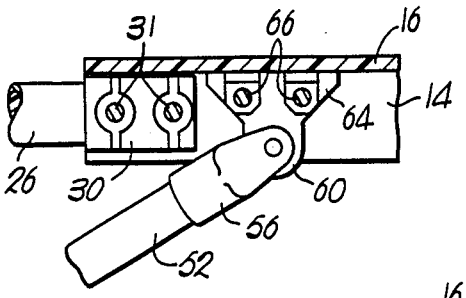
Fig.5.
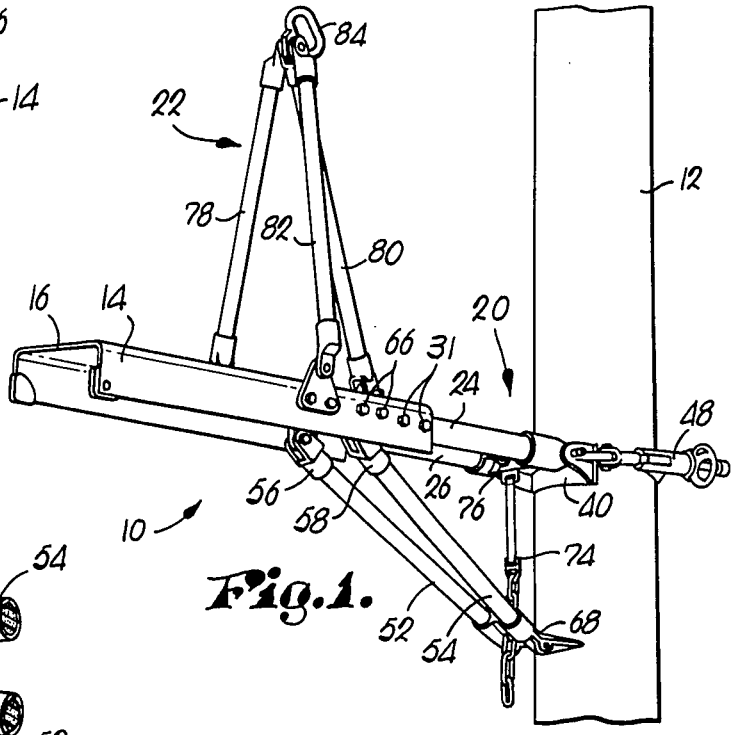
Fig.1.
Fig.3.
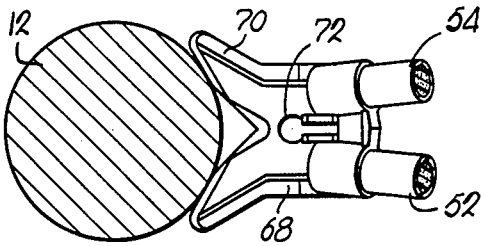
Fig.2.
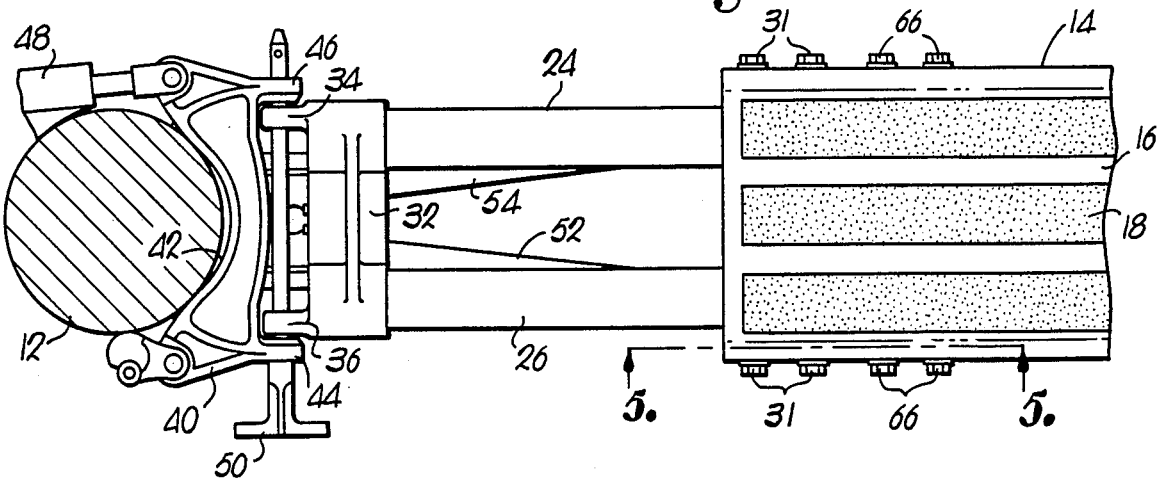
Fig.4.
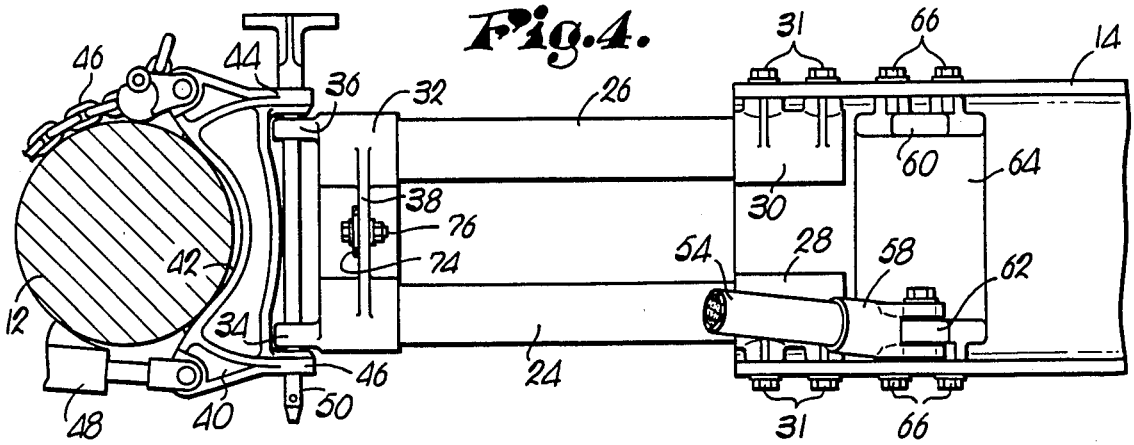

ELECTRICALLY INSULATED TEMPORARY AERIAL PLATFORM

BACKGROUND OF THE INVENTION

1. Field of the Invention

The present invention is concerned with an electrically insulated work platform for temporary attachment to a utility pole or the like in order to permit linemen to work on or around the pole. More particularly, it is concerned with such a platform which includes an elongated, smooth electrically insulative member serving to space the work platform from the pole and maintain the platform in an electrically insulated state during normal working conditions, notwithstanding the fact that the pole itself may be uninsulated.

2. Description of the Prior Art

Temporary platform structures have been provided in the past for use by linemen in their work. Generally speaking, such prior devices have included an elongated, rectangular platform, together with metallic connection apparatus directly secured to one end of the platform for temporarily securing the platform to a pole. Further, upright tripod or other types of railings are commonly attached to the platform to provide linemen handholds and safety belt attachments. Without known exception, these prior platforms have not provided, in and of themselves, a rated degree of electrical insulation. That is to say, the utility pole itself is generally considered as being non-insulative (although in fact it may provide a degree of electrical insulation), and moreover the prior temporary platform devices have not in and of themselves been rated from the standpoint of effective electrical insulation. Accordingly, linemen have been forced to adopt various expedients during work involving such platforms, such as the use of electrically insulative clothing (e.g. gloves). While such expedients are normally effective, in some cases they detract from worker efficiency, inasmuch as the linemen cannot move and perform his tasks with the most desirable degree of freedom of movement and speed.

SUMMARY OF THE INVENTION

The present invention provides an improved temporary work platform assembly for use on or around utility poles, which is characterized by enhanced insulative properties so as to give linemen an additional margin of safety. Broadly speaking, the platform assembly of the present invention includes a work platform presenting an elongated surface where a linemen may stand, sit or kneel, together with means for temporarily attaching the platform to an upright utility pole or the like. The platform surface is advantageously substantially flat and non-slip, although other surfaces, such as one made up of a plurality of juxtaposed cylindrical rods, could also be used. The attachment structure advantageously includes an elongated, electrically insulative member secured to and extending from the platform, with connection structure secured to the end of the insulative member remote from the platform for securing the member and platform to the pole. The insulative member is of a length, and is formed of an appropriate insulative material presenting a smooth outer surface, for resisting accumulation of dirt and other contaminants thereon and maintaining the platform electrically insulated from the pole connection structure during normal working conditions. The insulative member further presents a downwardly sloping upper surface in order to dissuade the lineman from directly contacting and supporting himself on the insulative member.

In practice, the preferred platform assembly of the invention includes at least one and advantageously a pair of laterally spaced apart, elongated, electrically insulative synthetic resin rods for the indicated purposes. The insulative rods are preferably formed of known fiberglass reinforced epoxy insulative material.

BRIEF DESCRIPTION OF THE DRAWING

FIG. 1 is a perspective view of a work platform assembly in accordance with the invention, shown operatively mounted on an upright utility pole;

FIG. 2 is a fragmentary view illustrating the details of construction of the platform assembly illustrated in FIG. 1;

FIG. 3 is a fragmentary sectional view depicting the construction of the depending, diagonally oriented support struts forming a part of the overall platform assembly;

FIG. 4 is a fragmentary bottom view of the platform assembly; and

FIG. 5 is a fragmentary sectional view taken along line 5—5 of FIG. 2 and depicting the connection of the insulative rods to the work platform.

DESCRIPTION OF THE PREFERRED EMBODIMENT

Turning now to the drawing, a work platform assembly 10 is illustrated in FIG. 1 operatively connected to an upright utility pole 12. The assembly 10 includes an elongated, generally U-shaped in cross section work platform 14 presenting a substantially flat upper work surface 16 having non-skid areas 18 thereon. Additionally, the overall assembly 10 includes means broadly referred to by the numeral 20 for temporarily attaching the platform 14 to pole 12, and a safety railing assembly 22 secured to and extending upwardly from the platform 14.

In more detail, the attachment structure 20 includes a pair of elongated, laterally spaced apart, cylindrical electrically insulative rods 24, 26 which are secured to the platform 14 and extend outwardly therefrom. Referring to FIGS. 4 and 5, it will be seen that each rod 24, 26 is provided with a terminal ferrule 28, 30, with each ferrule being in turn bolted to an adjacent side flange of the platform 14 through use of bolts 31. As indicated above, the rods 24, 26 are advantageously formed of fiberglass reinforced epoxy material which presents a smooth outer surface for resisting accumulation of dirt thereon.

The ends of the rods remote from the platform 14 are received within spaced sockets provided in an end cap ferrule 32 which spans the distance between the two rods. Ferrule 32 includes a pair of outwardly extending, apertured ears 34, 36, which are important for purposes to be made clear. In addition, the underside of ferrule 32 is provided with an apertured web 38.

The attachment means 20 further includes a pole-engaging saddle 40 presenting an arcuate pole-contacting surface 42. The saddle has a pair of apertured tangs 44, 46 which are spaced apart a distance for receiving therebetween the ears 34, 36 of ferrule 32. In addition, an attachment chain 46 and chain binder 48 are secured to the opposed ends of the saddle 40 so as to permit secure attachment of the saddle to pole 12. An elongated hinge pin 50 of length to extend through the aligned tangs 44, 46 of saddle 40, and through the apertured ears 34, 36 of ferrule 32, is provided for hingedly coupling the ferrule 32 to the saddle 40.

In order to provide additional support for the platform 14, a pair of downwardly extending, converging insulative struts 52, 54 are operatively coupled to the underside of platform 14. In detail, it will be seen that the upper end of each strut 52, 54, is provided with a clevis ferrule 56, 58. The respective ferrules 56, 58 are pivotally coupled to depending apertured tangs 60, 62 with the latter being integral with a connection bracket 64 secured to the underside of the platform 14 by means of appropriate threaded fasteners 66.

The lowermost ends of the struts 52, 54 are connected to a common pole-engaging fork ferrule 68. This ferrule 68 includes a pair of strut-receiving sockets as illustrated, together with a bifurcated pole-contacting engagement end 70 remote from the sockets. It will further be observed that the ferrule 68 is provided with a keyhole slot 72 in the approximate center thereof. In order to maintain the reinforcing struts 52, 54 in proper disposition, a vertical chain connector 74 is provided. The upper end of this connector 74 is affixed to the web 38 by means of bolt 76, with the lower chain section of the connector being adjustably received through the keyhole slot 72 of lower ferrule 68.

The railing assembly 22 in the illustrated embodiment includes three upwardly extending insulative rods 78, 80 and 82 which are operatively secured to platform 14 through conventional connectors. The rods 78–82 are also interconnected adjacent the upper ends thereof to present a tripod configuration, and a ring 84 is also provided at the top of the tripod assembly for connection of a lineman's safety belt thereto.

In the use of platform assembly 10, the lineman first attaches the saddle 40 to pole 12 at an appropriate location by making use of the chain and chain binder assembly. At this point the ears 34, 36 of ferrule 32 are placed within the tangs 44, 46 of the saddle 40, and hinge pin 50 is employed to interconnect the components. Thereupon, the chain connector 74 is adjusted to orient the pivotal depending struts 52, 54 so as to assure that platform 14 is essentially horizontal, whereupon the pole contacting end 70 of lower ferrule 68 is placed in firm contact with the pole 12. The platform assembly is now ready for use in supporting a lineman. To this end, the lineman normally either sits, stands or kneels on the surface 16 of the platform, after attaching his safety belt to ring 84. Of course, the upright tripod rods 78–82 can also provide additional handholds for the lineman. Inasmuch as the platform 14 is physically spaced from the pole 12 and the associated pole connection hardware by the insulative rods 24, 26 and insulative struts 52, 54, it will be appreciated that the platform is in fact electrically isolated from the pole and metallic hardware. This provides an enhanced degree of safety for the lineman. Moreover, the smooth, glass-like outer surfaces of the insulative members, and particularly the rods 24, 26, resist the accumulation of dirt or other contaminants which can lead to tracking and loss of insulative integrity. Finally, the downwardly sloping and preferably cylindrical surfaces presented by the rods 24, 26 serve to effectively dissuade a lineman from directly standing on or otherwise contacting and supporting himself on these members. This again serves to facilitate maintenance of these elements in a clean, non-contaminated condition.

I claim:

1. A work platform assembly for temporary use by a lineman on or around utility poles, said platform assembly comprising:

a work platform presenting an elongated surface where said lineman may stand, sit or kneel; and means for temporarily attaching said platform to a utility pole or the like, including an elongated electrically insulative member secured to and extending from said platform; and connection structure secured to the end of said insulative member remote from said platform for securing the member and platform to said pole or the like, said insulative member being of a length, and being formed of an insulative material presenting a smooth outer surface, for resisting accumulation of dirt thereon and maintaining said platform electrically insulated from said connection structure during normal working conditions, said insulative member further presenting a downwardly sloping upper surface in order to dissuade said lineman from directly contacting and supporting himself on the member.

2. The platform assembly of claim 1, said member comprising at least one elongated, electrically insulative, cylindrical synthetic resin rod.

3. The platform assembly of claim 2, said member comprising a pair of laterally spaced apart, parallel insulative rods.

4. The platform assembly of claim 1, said attachment means further including an elongated, downwardly extending reinforcing strut secured to said platform and adapted to engage said pole or the like beneath said connection structure.

5. The platform assembly of claim 1, including an upright safety rail assembly secured to said platform and extending above said surface.

6. The platform assembly of claim 1, said surface being substantially flat.

* * * * *